US008881535B2

(12) United States Patent
Hartwick et al.

(10) Patent No.: US 8,881,535 B2
(45) **Date of Patent: *Nov. 11, 2014**

(54) ELECTRIC FIELD CONTROL OF TWO OR MORE RESPONSES IN A COMBUSTION SYSTEM

(75) Inventors: Thomas S. Hartwick, Snohomish, WA (US); David B. Goodson, Seattle, WA (US); Christopher A. Wiklof, Everett, WA (US); Joseph Colannino, Mercer Island, WA (US)

(73) Assignee: Clearsign Combustion Corporation, Seattle, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/370,183

(22) Filed: Feb. 9, 2012

(65) Prior Publication Data

US 2012/0317985 A1 Dec. 20, 2012

Related U.S. Application Data

(60) Provisional application No. 61/441,229, filed on Feb. 9, 2011.

(51) Int. Cl.

| | |
|---|---|
| ***F02C 9/00*** | (2006.01) |
| ***F23C 5/00*** | (2006.01) |
| ***F23D 14/84*** | (2006.01) |
| ***F23C 5/14*** | (2006.01) |
| ***F23C 99/00*** | (2006.01) |

(52) U.S. Cl.

CPC . *F23D 14/84* (2013.01); *F23C 5/14* (2013.01); *F23C 99/001* (2013.01)

USPC ..... 60/793; 60/773; 431/8

(58) Field of Classification Search

USPC ..... 60/39.281, 39.091, 242, 772, 773, 734, 60/739, 793; 431/2, 8, 18, 258–266

See application file for complete search history.

(56) References Cited

U.S. PATENT DOCUMENTS

| | | | | |
|---|---|---|---|---|
| 2,604,936 | A | 7/1952 | Kaehni et al. | |
| 3,358,731 | A | 12/1967 | Donnelly | |
| 3,416,870 | A | 12/1968 | Wright | |
| 3,957,418 | A | 5/1976 | Sata | |
| 4,002,157 | A * | 1/1977 | Toesca | 126/110 B |
| 4,091,779 | A | 5/1978 | Saufferer et al. | |
| 4,093,430 | A | 6/1978 | Schwab et al. | |
| 4,110,086 | A | 8/1978 | Schwab et al. | |
| 4,111,636 | A | 9/1978 | Goldberg | |

(Continued)

OTHER PUBLICATIONS

Barmina "Active Electric Control of Emissions From Swirling Combustion", 2006, 405-407, 410 http://link.springer.com/book/10.1007/978-1-4020-6515-6/page/1.*

(Continued)

*Primary Examiner* — Phutthiwat Wongwian
*Assistant Examiner* — William Breazeal
(74) *Attorney, Agent, or Firm* — Christopher A. Wiklof; Harold H. Bennett, II; Launchpad IP, Inc.

(57) ABSTRACT

A combustion system may include a plurality of heated volume portions. At least two of the plurality of heated volume portions may include corresponding respective electrodes. The electrodes may be driven to produce respective electric fields in their respective volumes. The electric fields may be configured to drive desired respective responses.

35 Claims, 6 Drawing Sheets

(56) References Cited

U.S. PATENT DOCUMENTS

| | | | | |
|---|---|---|---|---|
| 4,675,029 | A | 6/1987 | Norman et al. | |
| 4,842,190 | A | 6/1989 | Orchard | |
| 5,288,303 | A | 2/1994 | Woracek et al. | |
| 5,654,868 | A | 8/1997 | Buer | |
| 5,702,244 | A | 12/1997 | Goodson et al. | |
| 5,971,745 | A * | 10/1999 | Bassett et al. | 431/12 |
| 6,640,549 | B1 | 11/2003 | Wilson et al. | |
| 6,742,340 | B2 | 6/2004 | Nearhoof, Sr. et al. | |
| 6,887,069 | B1 | 5/2005 | Thornton et al. | |
| 7,128,818 | B2 | 10/2006 | Khesin et al. | |
| 7,137,808 | B2 * | 11/2006 | Branston et al. | 431/8 |
| 7,243,496 | B2 | 7/2007 | Pavlik et al. | |
| 7,377,114 | B1 | 5/2008 | Pearce | |
| 7,770,380 | B2 | 8/2010 | Dulligan et al. | |
| 7,845,937 | B2 | 12/2010 | Hammer et al. | |
| 8,082,725 | B2 * | 12/2011 | Younsi et al. | 60/39.76 |
| 8,245,951 | B2 | 8/2012 | Fink et al. | |
| 2012/0317985 | A1 | 12/2012 | Hartwick et al. | |
| 2013/0004902 | A1 | 1/2013 | Goodson et al. | |
| 2013/0071794 | A1 | 3/2013 | Colannino et al. | |
| 2013/0170090 | A1 | 7/2013 | Colannino et al. | |
| 2013/0230810 | A1 | 9/2013 | Goodson et al. | |
| 2013/0230811 | A1 | 9/2013 | Goodson et al. | |
| 2013/0255482 | A1 | 10/2013 | Goodson | |
| 2013/0255548 | A1 | 10/2013 | Goodson et al. | |
| 2013/0255549 | A1 | 10/2013 | Sonnichsen et al. | |
| 2013/0260321 | A1 | 10/2013 | Colannino et al. | |

OTHER PUBLICATIONS

Testo, "Portable Emissions Analyzer System", 2009, Testo, p. 10 http://www.ierents.com/Spec%20Pages/testo_350XL.pdf.*

Chase "Combined-Cycle Development Evolution and Future", 2000 , GE Power SystemsPages 5-6 http://physics.oregonstate.edu/~hetheriw/energy/topics/doc/elec/natgas/cc/combined%20cycle%20development%20evolution%20and%20future%20GER4206.pdf.*

PCT International Search Report and Written Opinion of PCT Application No. PCT/US2012/024541 mailed Jun. 20, 2012.

Altendrfner et al., "Electric Field Effects on Emissions and Flame Stability With Optimized Electric Field Geometry", Third European Combustion Meeting ECM 2007, p. 1-6.

William T. Brande; "The Bakerian Lecture: On Some New Electro-Chemical Phenomena", Phil. Trans. R. Soc. Lond. 1814 104, p. 51-61.

* cited by examiner

ELECTRIC FIELD CONTROL OF TWO OR MORE RESPONSES IN A COMBUSTION SYSTEM

CROSS-REFERENCE TO RELATED APPLICATIONS

The present application claims priority benefit under 35 USC §119(e) to U.S. Provisional Application Ser. No. 61/441,229; entitled "ELECTRIC FIELD CONTROL OF TWO OR MORE RESPONSES IN A COMBUSTION SYSTEM", invented by Thomas S. Hartwick, David B. Goodson, and Christopher A. Wiklof; filed on Feb. 9, 2011; which is co-pending herewith at the time of filing, and which, to the extent not inconsistent with the disclosure herein, is incorporated by reference.

OVERVIEW

According to an embodiment, at least one first electric field may be controlled to drive a first response and at least one second electric field may be controlled to drive a second response in a heated volume of a combustion system. The responses may be chemical or physical. A first portion of the heated volume may correspond to at least one combustion reaction zone. A second portion of the heated volume may correspond to a heat transfer zone, a pollution abatement section, and/or a fuel delivery section.

The at least one first and at least one second electric fields may include one or more DC electric fields, one or more AC electric fields, one or more pulse trains, one or more time-varying waveforms, one or more digitally synthesized waveforms, and/or one or more analog waveforms.

One or more sensors may be disposed to sense one or more responses to the electric fields. For example, the first electric field may be driven to maximize combustion efficiency. Additionally or alternatively, the first response may include swirl, mixing, reactant collision energy, frequency of reactant collisions, luminosity, thermal radiation, and stack gas temperature. The second electric field may be driven to produce a second response different from the first response. For example, the second response may select a heat transfer channel, clean combustion products from a heat transfer surface, maximize heat transfer to a heat carrying medium, precipitate an ash, minimize nitrogen oxide output, and/or recycle unburned fuel. Accordingly, the second response may include driving hot gases against or along or away from one or more heat transfer surfaces, precipitating ash, driving an oxide of nitrogen-producing reaction to minimum extent of reaction, activating fuel, and/or steering fuel particles.

A controller may modify at least one of the first or second electric fields responsive to detection of at least one input variable and/or at least one received sensor datum. For example, the at least one input variable includes fuel flow rate, electrical demand, steam demand, turbine demand, and/or fuel type.

DETAILED DESCRIPTION

Figure 1:
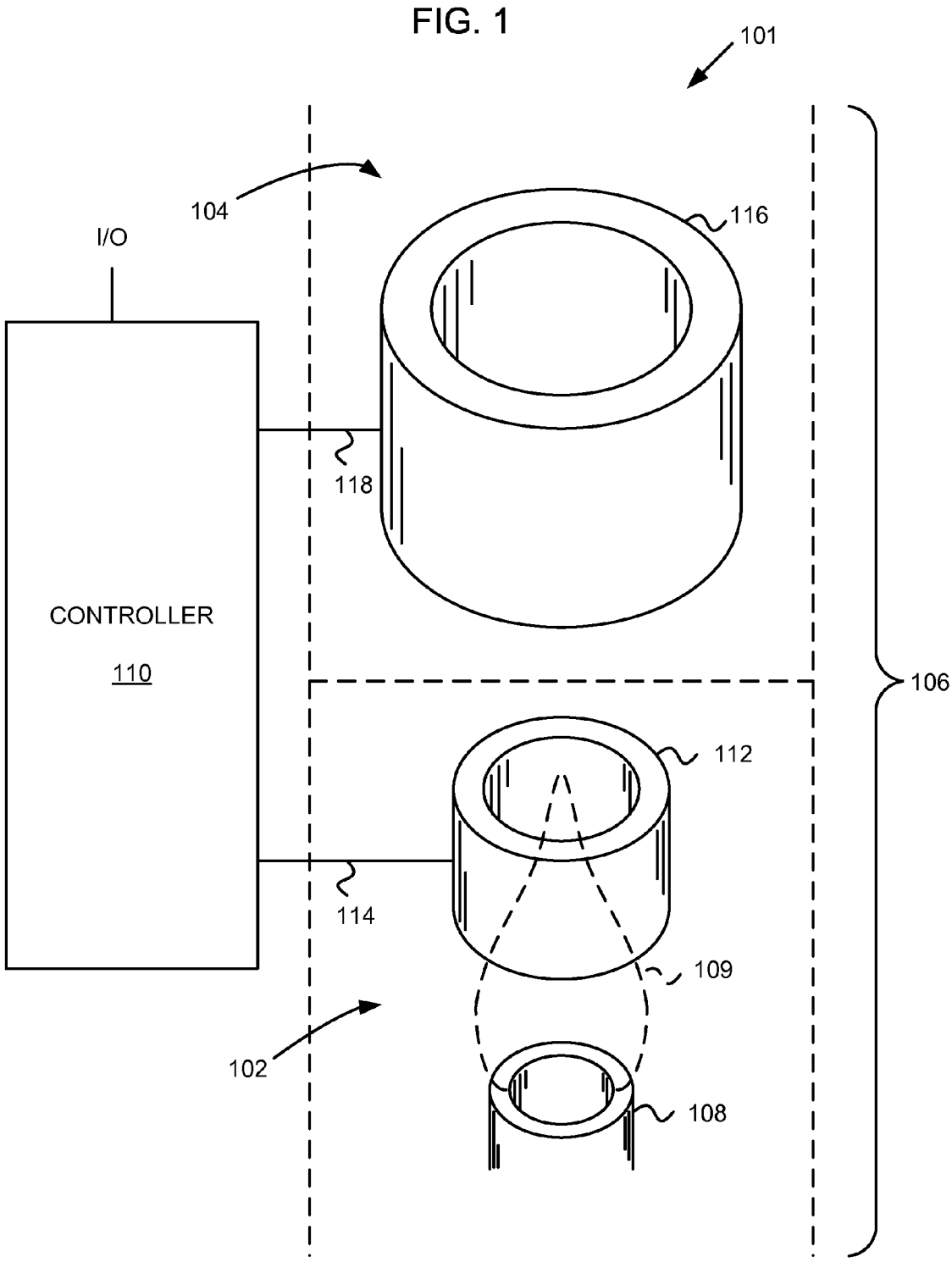
FIG. 1 is a diagram illustrating a combustion system configured to select two or more responses from respective portions of a heated volume using electric fields, according to an embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein.

FIG. 1 is a diagram illustrating a combustion system 101 configured to select two or more responses from respective portions 102, 104 of a heated volume 106 using electric fields, according to an embodiment.

A burner 108 disposed in a first portion 102 of the heated volume 106 may be configured to support a flame 109. An electronic controller 110 is configured to produce at least a first and a second electrode drive signal. The first portion 102 of the heated volume 106 may include a substantially atmospheric pressure combustion volume including one or more than one burner 108. The first and second electric fields and the first and second portions 102, 104 of the heated volume 106 may be substantially non-overlapping. For example, the first and second electric fields may be formed respectively in a boiler combustion volume and a flue. According to other embodiments, the first and second portions 102, 104 of the heated volume 106 may overlap at least partially.

At least one first electrode 112 may be arranged proximate the flame 109 supported by the burner 108 and operatively coupled to the electronic controller 110 to receive the first electrode drive signal via a first electrode drive signal transmission path 114. The first electrode drive signal may be configured to produce a first electric field configuration in at least the first portion 102 of the heated volume 106. The first electric field configuration may be selected to produce a first response from the system 101.

The at least one first electrode may include a range of physical configurations. For example, the burner 108 may be electrically isolated and driven to form the at least one first electrode. Additionally or alternatively, the at least one first electrode 112 may include a torus or a cylinder as diagrammatically illustrated in FIG. 1. According to another embodiment, the at least one first electrode 112 may include a charge rod such as a [[ . . . ]]¼" outside diameter tube of Type 304 Stainless Steel held transverse or parallel to a flow region defined by the burner 108. One or more second features (not shown) arranged relative to the at least one first electrode may optionally be held at a ground or a bias voltage with the first electric field configuration being formed between the at least one first electrode and the one or more second features. Optionally, the at least one first electrode may include at least two first electrodes and the first electric field configuration may be formed between the at least two first electrodes.

Within constraints disclosed herein, an electric field configuration may include a static electric field, a pulsing electric field, a rotating electric field, a multi-axis/electric field, an AC electric field, a DC electric field, a periodic electric field, a non-periodic electric field, a repeating electric field, a random electric field, or a pseudo-random electric field.

At least one second electrode 116 may be arranged distal, in a direction parallel to a longitudinal axis of the burner 108, from the flame 109 supported by the burner 108, relative to the at least one first electrode 112. The at least one second electrode 116 may be operatively coupled to the electronic controller 110 to receive the second electrode drive signal via a second electrode drive signal transmission path 118. The second electrode drive signal may be configured to produce a second electric field configuration in the second portion 104 of the heated volume 106. The second electric field configuration may be selected to produce a second response from the system 101.

The first response may be limited to a response that occurs in the first portion 102 of the heated volume 106 and the second response may be limited to a response that occurs in the second portion 104 of the heated volume 106. The first and second responses may be related to respective responses of first and second populations of ionic species present within the first and second portions 102, 104 of the heated volume 106.

For example, the at least one first electrode 112 may be driven to produce a first electric field in the first portion 102 of the heated volume 106 selected to drive combustion within and around the flame 109 to a greater extent of reaction compared to an extent of reaction reached with no electric field. For example, the at least one second electrode 116 may be driven to produce a second electric field in the second portion 104 of the heated volume 106 selected to drive greater heat transfer from the heated volume compared to an amount of heat transfer reached with no electric field.

Figure 2:
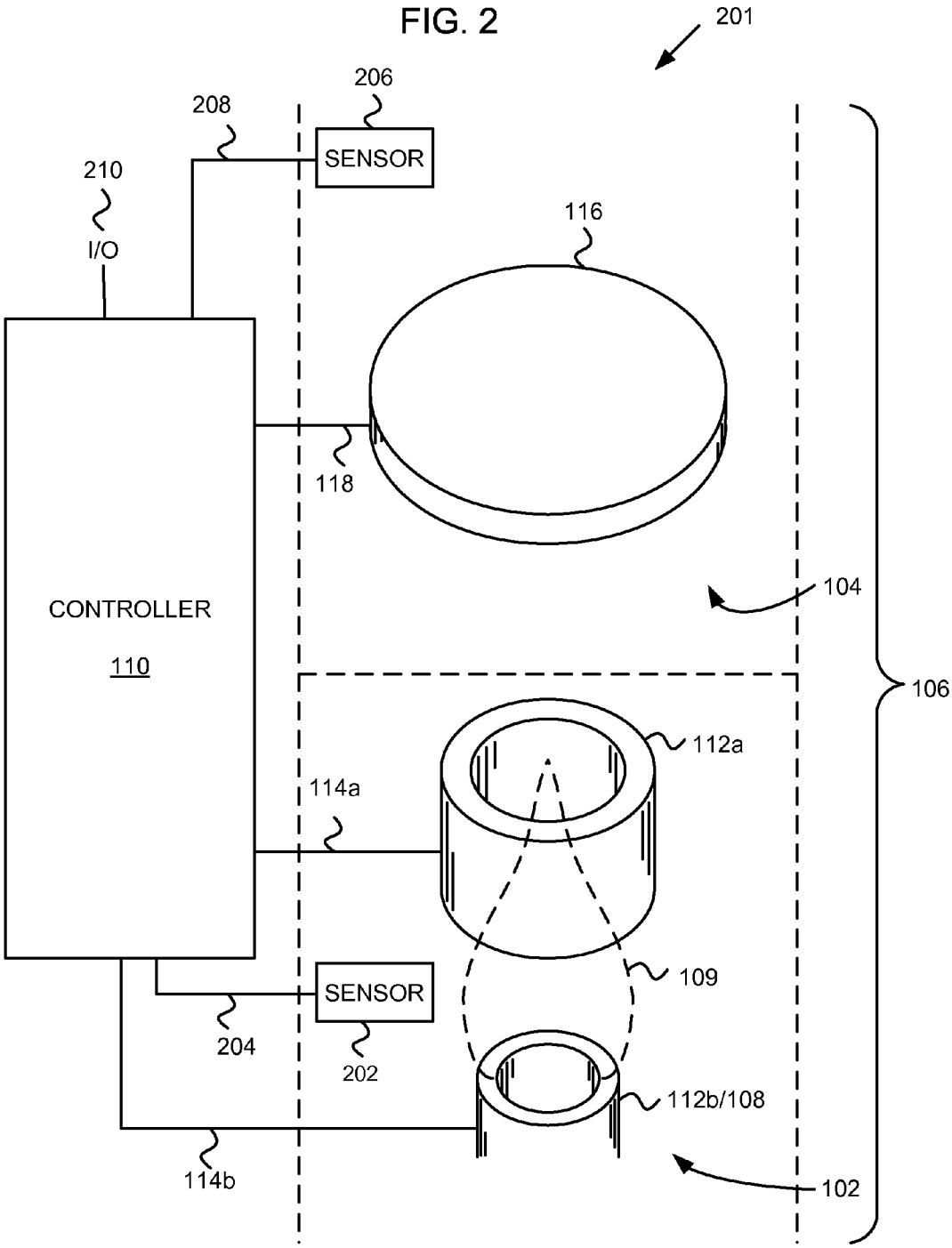
FIG. 2 is a diagram illustrating a combustion system configured to select two or more responses from respective portions of a heated volume using electric fields, according to another embodiment.

FIG. 2 is a diagram illustrating a combustion system 201 configured to select two or more responses from respective portions 102, 104 of a heated volume 106 using electric fields, according to another embodiment.

The system embodiments of FIGS. 1 and 2 may be configured such that at least one of the first electrode and the second electrode includes at least two electrodes. For example, in the system 201 shown in FIG. 2, the electrode for the first portion 102 of the heated volume 106 may include a first electrode portion 112*a* configured as a ring electrode, and a second electrode portion 112*b* configured as a burner electrode. The electrode portions 112*a*, 112*b* may be driven by respective first electrode drive signal transmission paths 114*a*, 114*b*.

At least one first sensor 202 may be disposed to sense a condition proximate the flame 109 supported by the burner 108. The first sensor(s) 202 may be operatively coupled to the electronic controller via a first sensor signal transmission path 204. The first sensor(s) 202 may be configured to sense a combustion parameter of the flame 109. For example, the first sensor(s) 202 may include one or more of a flame luminance sensor, a photo-sensor, an infrared sensor, a fuel flow sensor, a temperature sensor, a flue gas temperature sensor, an acoustic sensor, a CO sensor, an O2 sensor, a radio frequency sensor, and/or an airflow sensor.

At least one second sensor 206 may be disposed to sense a condition distal, in a direction parallel to the longitudinal axis of the burner 108, from the flame 109 supported by the burner 108, relative to the condition sensed by the at least one first sensor 202, and operatively coupled to the electronic controller 110 via a second sensor signal transmission path 208. The at least one second sensor 206 may be disposed to sense a parameter corresponding to a condition in the second portion 104 of the heated volume 106. For example, for an embodiment where the second portion 104 includes a pollution abatement zone, the second sensor may sense optical transmissivity corresponding to an amount of ash present in the second portion 104 of the heated volume 106. According to various embodiments, the second sensor(s) 206 may include one or more of a transmissivity sensor, a particulate sensor, a temperature sensor, an ion sensor, a surface coating sensor, an acoustic sensor, a CO sensor, an O2 sensor, and an oxide of nitrogen sensor.

According to an embodiment, the second sensor 206 may be configured to detect unburned fuel. The at least one second electrode 116 may be configured, when driven, to force unburned fuel downward and back into the first portion 102 of the heated volume 106. For example, unburned fuel may be positively charged. When the second sensor 206 transmits a signal over the second sensor signal transmission path 208 to the controller 110, the controller may drive the second electrode 116 to a positive state to repel the unburned fuel. Fluid flow within the heated volume 106 may be driven by electric field(s) formed by the at least one second electrode 116 and/or the at least one first electrode 112 to direct the unburned fuel downward and into the first portion 102, where it may be further oxidized by the flame 109, thereby improving fuel economy and reducing emissions.

Optionally, the controller 110 may drive the first portion 112*a* of the at least one first electrode and/or the second portion 112*b* of the at least one first electrode to cooperate with the at least one second electrode 116. According to some embodiments, such cooperation may drive the unburned fuel downward more effectively than by the actions of the at least one second electrode 116 alone. For example, a series of pulses to the electrodes 116, 112*a*, 112*b* may relay the unburned fuel downward. A first portion of the relay may include the at least one second electrode 116 being driven positive while the first portion 112*a* of the at least first electrode is driven negative. Such a configuration may drive positively charged unburned fuel particles from the vicinity of the at least one second electrode 116 to the vicinity of the first portion 112*a* of the at least one first electrode. Then, as the unburned fuel particles near the first portion 112*a* of the at least one first electrode, that portion 112*a* may be allowed to float, and the second portion 112*b* of the at least one first electrode may be driven negative, thus continuing the propulsion of the fuel particles downward and into the flame 109.

Figure 3:
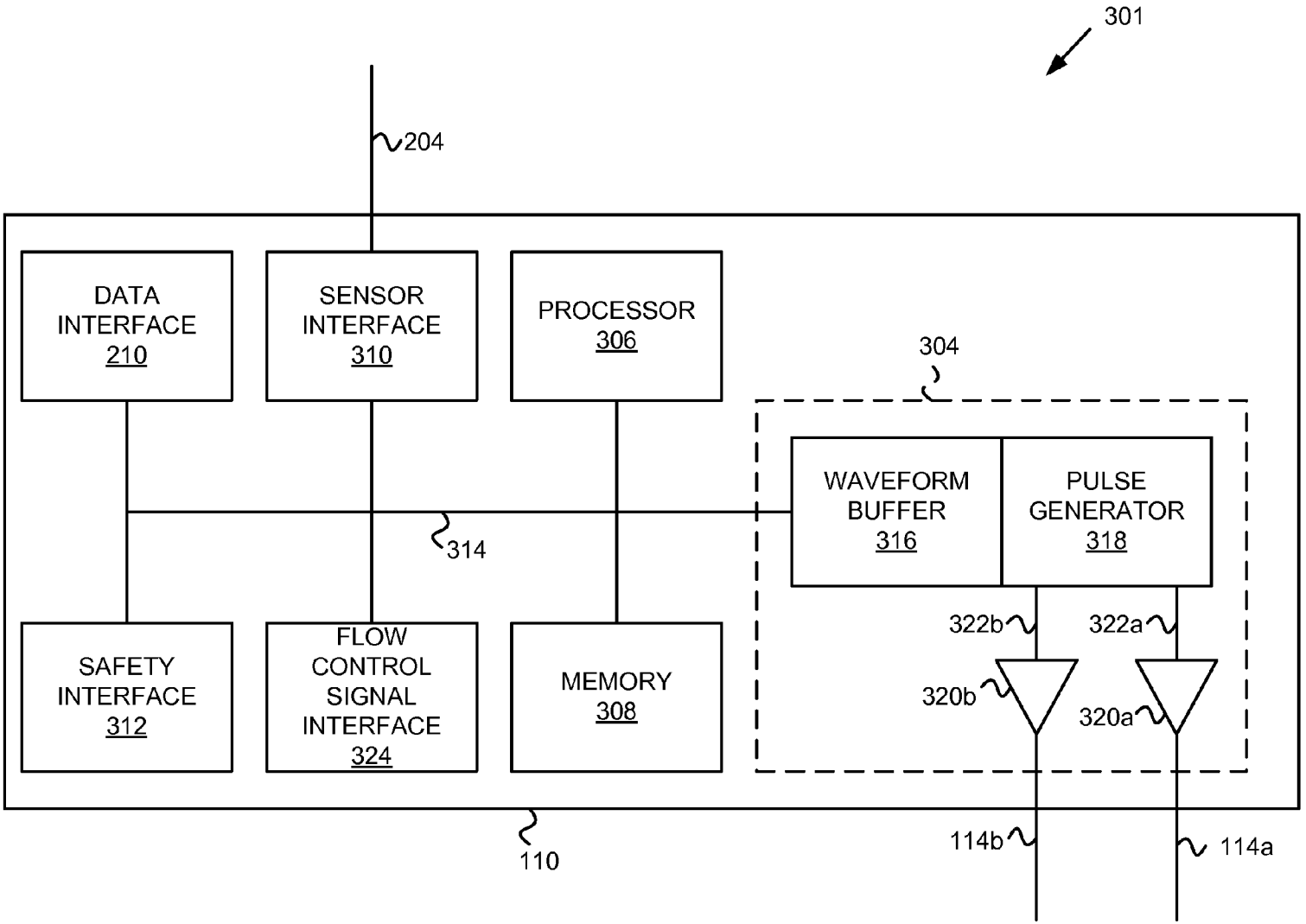
FIG. 3 is a block diagram of a controller for the system of FIGS. 1-2, according to an embodiment.

The controller 110 may include a communications interface 210 configured to receive at least one input variable. FIG. 3 is a block diagram of an illustrative embodiment 301 of a controller 110. The controller 110 may drive the first electrode drive signal transmission paths 114*a* and 114*b* to produce the first electric field whose characteristics are selected to provide at least a first effect in the first heated volume portion 102. The controller may include a waveform generator 304. The waveform generator 304 may be disposed internal to the controller 110 or may be located separately from the remainder of the controller 110. At least portions of the waveform generator 304 may alternatively be distributed over other components of the electronic controller 110 such as a microprocessor 306 and memory circuitry 308. An optional sensor interface 310, communications interface 210, and safety interface 312 may be operatively coupled to the microprocessor 306 and memory circuitry 308 via a computer bus 314.

Logic circuitry, such as the microprocessor 306 and memory circuitry 308 may determine parameters for electrical pulses or waveforms to be transmitted to the first electrode(s) via the first electrode drive signal transmission path(s) 114*a*, 114*b*. The first electrode(s) in turn produce the first electrical field. The parameters for the electrical pulses or waveforms may be written to a waveform buffer 316. The contents of the waveform buffer may then be used by a pulse generator 318 to generate low voltage signals 322*a*, 322*b* corresponding to electrical pulse trains or waveforms. For example, the microprocessor 306 and/or pulse generator 318 may use direct digital synthesis to synthesize the low voltage signals. Alternatively, the microprocessor may write variable values corresponding to waveform primitives to the waveform buffer 316. The pulse generator 318 may include a first resource operable to run an algorithm that combines the variable values into a digital output and a second resource that performs digital to analog conversion on the digital output.

One or more outputs are amplified by amplifier(s) 320*a* and 320*b*. The amplified outputs are operatively coupled to the first electrode signal transmission path(s) 114*a*, 114*b*. The amplifier(s) may include programmable amplifiers. The amplifier(s) may be programmed according to a factory setting, a field setting, a parameter received via the communications interface 210, one or more operator controls and/or algorithmically. Additionally or alternatively, the amplifiers 320*a*, 320*b* may include one or more substantially constant gain stages, and the low voltage signals 322*a*, 322*b* may be driven to variable amplitude. Alternatively, output may be fixed and the heated volume portions 102, 104 may be driven with electrodes having variable gain.

The pulse trains or drive waveforms output on the electrode signal transmission paths 114*a*, 114*b* may include a DC signal, an AC signal, a pulse train, a pulse width modulated signal, a pulse height modulated signal, a chopped signal, a digital signal, a discrete level signal, and/or an analog signal.

According to an embodiment, a feedback process within the controller 110, in an external resource (such as a host computer or server) (not shown), in a sensor subsystem (not shown), or distributed across the controller 110, the external resource, the sensor subsystem, and/or other cooperating circuits and programs may control the first electrode(s) 112*a*, 112*b* and/or the second electrode(s) 116. For example, the feedback process may provide variable amplitude or current signals in the at least one first electrode signal transmission path 114*a*, 114*b* responsive to a detected gain by the at least one first electrode or response ratio driven by the electric field.

The sensor interface 310 may receive or generate sensor data (not shown) proportional (or inversely proportional, geometrical, integral, differential, etc.) to a measured condition in the first portion 102 of the heated volume 106.

The sensor interface 310 may receive first and second input variables from respective sensors 202, 206 responsive to physical or chemical conditions in the first and second portions 102, 104 of the heated volume 106. The controller 110 may perform feedback or feed forward control algorithms to determine one or more parameters for the first and second drive pulse trains, the parameters being expressed, for example, as values in the waveform buffer 316.

Optionally, as will be described more fully below, the controller 110 may include a flow control signal interface 324. The flow control signal interface may be used to generate flow rate control signals to control fuel flow and/or air flow through the combustion system.

Figure 4:
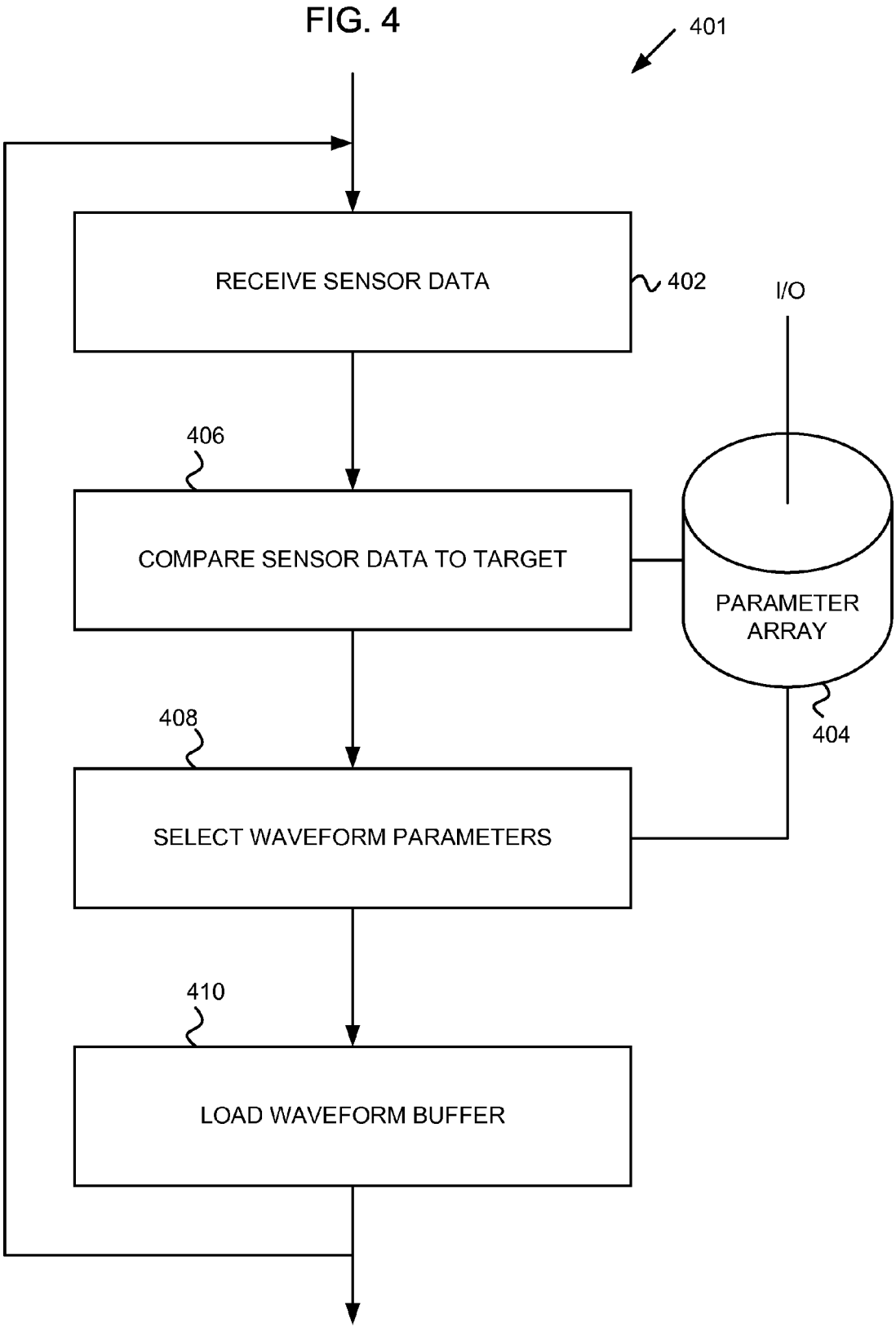
FIG. 4 is a flow chart showing a method for maintaining one or more programmable illustrative relationships between sensor feedback data and output signals to the electrodes, according to an embodiment.

A flow chart showing a method 401 for maintaining one or more illustrative relationships between the sensor data and the low voltage signal(s) 322*a*, 322*b* is shown in FIG. 4, according to an embodiment. For example, one or more illustrative relationships may include one or more programmable relationships.

In step 402, sensor data is received from the sensor interface 310. The sensor data may be cached in a buffer or alternatively be written to the memory circuitry 308. One or more target values for the sensor data may be maintained in a portion of the memory circuitry 308 as a parameter array 404. Proceeding to step 406, the received sensor data is compared to one or more corresponding values in the parameter array 404.

In step 408, at least one difference between the sensor data and the one or more corresponding parameter values is input to a waveform selector, the output of which is loaded into the waveform buffer 316 in step 410.

According to some embodiments, at least one parameter of the first and second electric fields may be interdependent. Thus, the parameter array may be loaded with a plurality of multivariate functions of sensor vs. target values and electric field waveforms that are mutually determinate. For example, referring to FIG. 3, the controller 110 may receive at least one response value from the heated volume 106. The microprocessor 306 may calculate at least one first parameter of the first electric field responsive to the at least one response value and calculate at least one second parameter of the second electric field responsive to the at least one response value and the at least one first parameter.

In other embodiments, the first and second electric fields in the first and second portions 102, 104 of the combustion volume 106 substantially do not directly interact. In such cases (and in some embodiments, in other cases), the parameter array 404 may include waveform parameters that are not mutually determinate.

Referring again to FIG. 4, the parameter array 404 may also include a fuel flow rate and/or one or more waveform parameters that are selected and loaded into the parameter array 404 as a function of a fuel flow rate.

Step 408 may include determining a first electric field amplitude and/or a first electric field pulse width responsive to a fuel flow rate and determining at least one of a second electric field amplitude and a second electric field pulse width responsive to the at least one of a first electric field amplitude and a first electric field pulse width.

The process 401 may be repeated, for example at a system tick interval.

The controller 110 may determine at least one parameter of at least one of the first and second electric field drive signals responsive to the at least one input variable. For example, the at least one input variable may include one or more of fuel flow rate, electrical demand, steam demand, turbine demand, and/or fuel type.

The controller 110 may further be configured to control a feed rate to the burner 108. For example, referring to FIG. 5, the controller 110 may produce an air feed rate control signal on an air feed rate control signal transmission path 502 to variably drive a fan or baffle, etc. 504. The burner may thereby receive more or less oxygen, which (other things being equal) may control the richness of the flame 109. Similarly, the controller 110 may produce a fuel feed (rate, mix, etc.) control signal on a fuel feed control signal transmission path 506. The fuel feed control signal transmission path 506 may couple the controller 110 to a control apparatus 508. For example, the control apparatus 508 may include a valve to modulate fuel flow rate to the burner 108.

Figure 5:
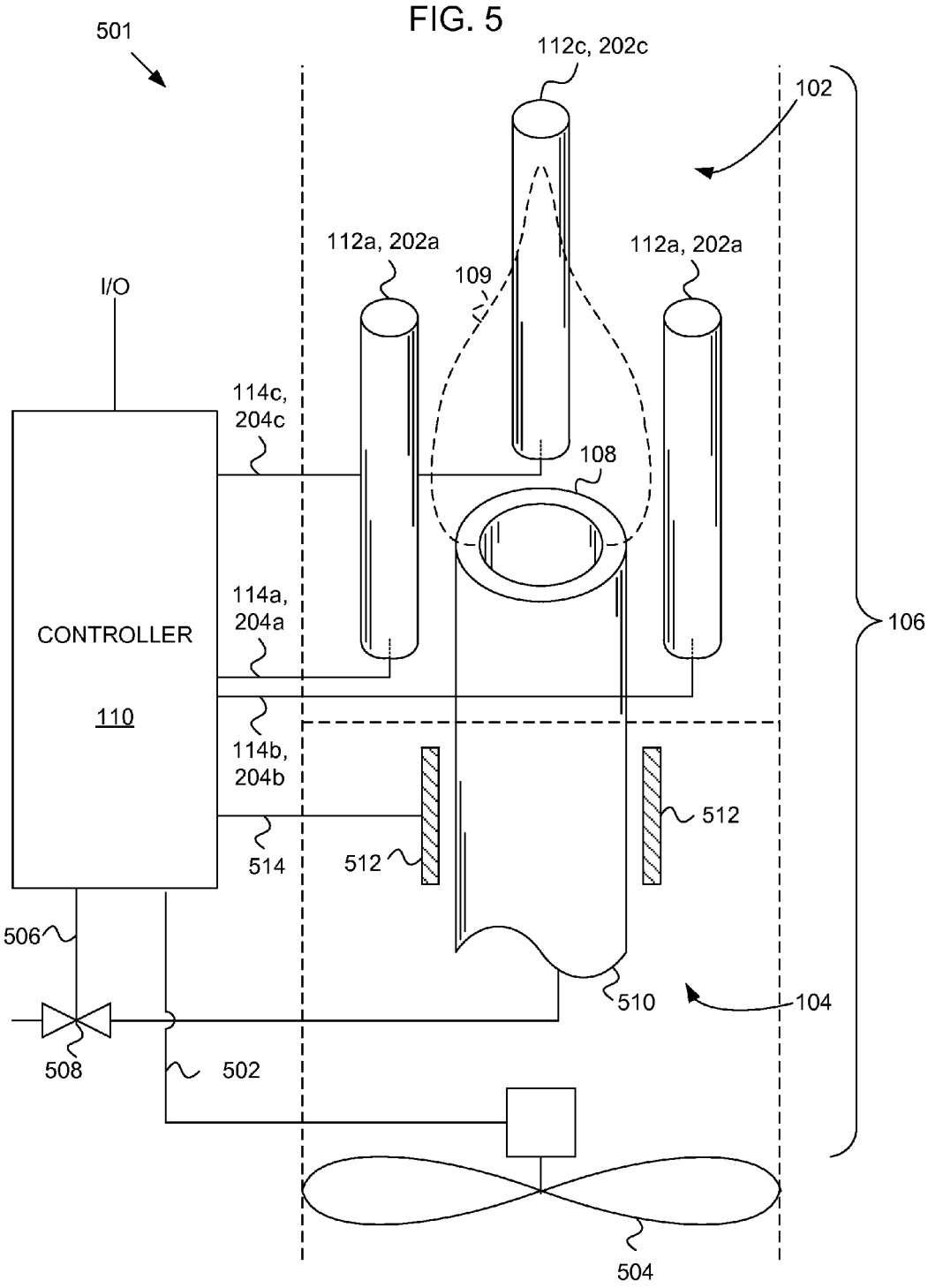
FIG. 5 is a block diagram of a combustion system including a controller to control fuel, airflow, and at least two electric fields produced in respective portions of a heated volume, according to an embodiment.

FIG. 5 also illustrates a combustion system 501 configured to produce at least two electric fields in respective portions of a heated volume, according to an embodiment wherein one of the portions includes a fuel delivery apparatus 510. Strictly speaking, the fuel delivery apparatus 510 need not be in a literally heated portion 104 of the heated volume, but for ease of description, the heated volume will be understood to extend to a portion 104 corresponding to the fuel delivery apparatus 510.

The fuel delivery apparatus 510 may be configured to receive an electric field from one or more electrodes 512 coupled to receive corresponding electrode drive signals from the controller 110 via an electrode drive signal transmission path 514. The electric field produced across the fuel delivery apparatus 510 may be driven to "crack" or activate the fuel just prior to combustion. To reduce recombination of the fuel prior to exiting the burner 108, it may be advantageous to apply the fuel delivery apparatus electric field relatively close to the burner 108. For example, the fuel delivery apparatus 510 may include a ceramic burner body that feeds the burner 108. The one or more electrodes 512 may include conductors buried in the ceramic burner body, may include opposed plates having a normal line passing through the ceramic burner body, may include an electrode tip suspended in the fuel flow path by an assembly including a shielded electrode transmission path, may include an annulus or cylinder, and/or may include a corona wire or grid, optionally in the form of a corotron or scorotron.

Finally, also provided are electrodes 112*a*, 112*b*, and 112*c* that may be driven by respective electrode drive signal transmission lines 114*a*, 114*b*, and 114*c* by controller 110. The electrodes 112*a*, 112*b*, and 112*c* may be disposed to form a modulated electric field in the first portion 102 of the heated volume 106 wherein a burner 108 supports a flame 109. The electric field may be driven to provide swirl and/or otherwise accelerate combustion in and near the flame 109. At least one response to the electric field generated by the electrodes 112*a*, 112*b*, and 112*c* may also be sensed by the electrodes 202*a*, 202*b*, and 202*c*. The electric field drive electrode 112*a* may thus also be referred to as an electric field sensor 202*a*. Similarly electric field drive electrodes/sensors 112*b*, 202*b* and 112*c*, 202*c* may also be used for both electric field driving and sensing. Similarly, at least portions of the electrode drive signal transmission paths 114*a*, 114*b*, and 114*c* may also serve as respective sensor signal transmission paths 204*a*, 204*b*, 204*c*.

Figure 6:
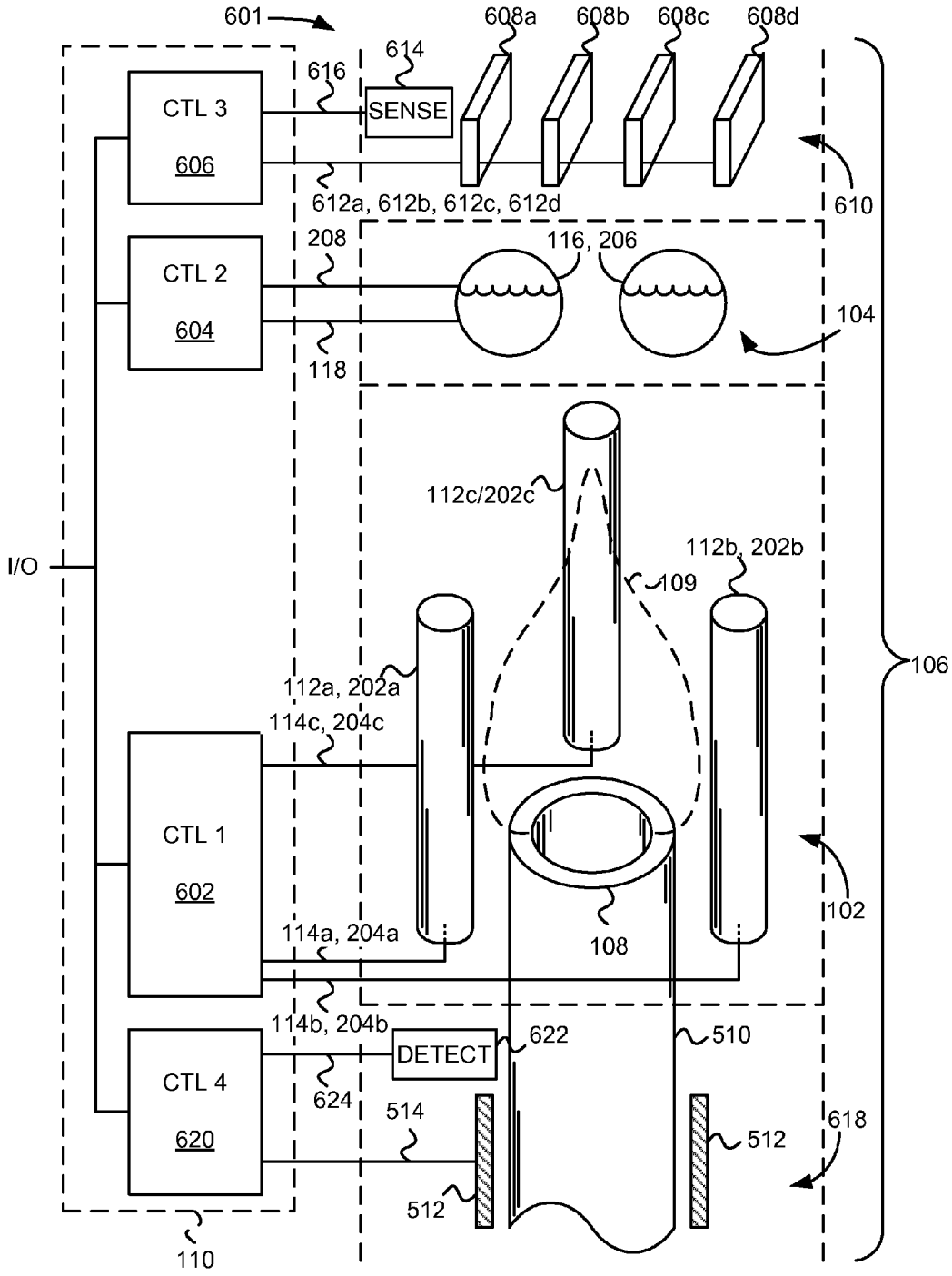
FIG. 6 is a diagram of a system using a plurality of controller portions to drive respective responses from portions of a combustion system, according to an embodiment.

FIG. 6 is a diagram of a system using a plurality of controller portions 602, 604, 606, 620 to drive respective responses from portions 102, 104, 610, 618 of a heated volume 106 in a combustion system 601, according to an embodiment. The controller portions 602, 604, 606, 620 may be physically disposed within a controller 110. Alternatively, the controller portions 602, 604, 606, 620 may be distributed, for example such that they are in proximity to their respective heated volume portions 102, 104, 610, 618.

Some or all of the controller portions 602, 604, 606, 620 may include substantially the relevant entirety of the controller 110 corresponding to the block diagram 301 of FIG. 3. Alternatively, referring to FIG. 3, portions of the controller function may be integrated in one or more shared resources, and other portions of the controller function may be distributed among the controller portions 602, 604, 606, 620. For example, according to an embodiment, each of the controller portions 602, 604, 606, 620 may include a waveform generator 304, while the other portions of the controller 110 such as the microprocessor 306, memory circuitry 308, sensor interface 310, safety interface 312, bus 314, communications interface 210, and the flow control signal interface 324 are disposed in a common resource within the controller 110.

Returning to FIG. 6, electrodes 112*a*, 112*b*, and 112*c* may be driven by respective electrode drive signal transmission lines 114*a*, 114*b*, 114*c* by the controller portion 602. The electrodes 112*a*, 112*b*, and 112*c* may be disposed to form a modulated electric field in the first portion 102 of the heated volume 106 wherein a burner 108 supports a flame 109. The electric field may be driven to provide swirl and/or otherwise accelerate combustion in and near the flame 109. At least one response to the electric field generated by the electrodes 112*a*, 112*b*, and 112*c* may also be sensed by the electrodes 202*a*, 202*b*, 202*c*. The electric field drive electrode 112*a* may thus also be referred to as an electric field sensor 202*a*. Similarly electric field drive electrodes/sensors 112*b*, 202*b* and 112*c*, 202*c* may also be used for both electric field driving and sensing. Similarly, at least portions of the electrode drive signal transmission paths 114*a*, 114*b*, 114*c* may also serve as respective sensor signal transmission paths 204*a*, 204*b*, 204*c*.

A second controller portion 604 may drive an electrode 116 disposed in a second portion 104 of the heated volume 106 via an electrode drive signal transmission path 118. According to an embodiment, the electrode 116 may be configured as the wall at a thermocouple junction 206 (not shown) configured to remove heat from the heated, and still ionized, gases exiting the first portion 102 of the heated volume 106. A sensor signal transmission path 208 may couple to a portion of the heat exchanger wall at a thermocouple junction 206 (not shown). Feedback from the sensor signal transmission path 118 may be used, for example, to control a water flow rate into the heat exchanger and/or control gas flow to the flame 109.

Thus, the combustion system 601 may provide functionality for a variable-output boiler, configured to heat at a variable rate according to demand. Of course, the burner 108 may include a plurality of burners with fuel flow being provided to a number of burners 108 appropriate to meet continuous and/or surge demand.

A third controller portion 606 may drive electrodes 608*a*, 608*b*, 608*c*, 608*d* disposed in a third portion 610 of the heated volume 106. The third controller portion 606 may drive the electrodes 608*a*, 608*b*, 608*c*, 608*d* through respective electrode drive signal transmission paths 612*a*, 612*b*, 612*c*, 612*d*. The electrodes 608*a*, 608*b*, 608*c*, 608*d* may be configured as electrostatic precipitation plates operable to trap ash, dust, and/or other undesirable stack gas components from the gases passing through the heated volume portion 610.

Optionally, a sensor 614 may transmit a sensor signal through a sensor signal transmission path 616 to the controller portion 606. The sensor 614 may be configured to sense a condition indicative of a need to recycle gases from the heated volume portion 610 back to the first heated volume portion 102 for further heating and combustion. For example, the sensor 614 may include a spectrometer configured to detect the presence of unburned fuel in the heated volume portion 610.

Upon receiving a signal from the sensor 614 via the sensor signal transmission path 616, the controller portion 606 may momentarily set the polarity of the electrodes 608*a*, 608*b*, 608*c*, 608*d* to drive ionic species present in the heated volume portion 610 downward and back into the vicinity of the flame 109. Gases and uncharged fuel particles present in the gases within the heated volume portion 610 may be entrained with the ionic species. Alternatively, substantially all the fuel particles within the heated volume portion 610 may retain charge and be driven directly by the electric field provided by the electrodes 608*a*, 608*b*, 608*c*, 608*d*.

A fourth portion 618 of the heated volume 106, which as described above may be considered a heated volume portion by convention used herein rather than literally heated, may correspond to a fuel feed apparatus 510. A controller portion 620 may drive an electrode 512, disposed proximate the fuel feed apparatus 510, via an electrode drive signal transmission path 514 to activate the fuel, as described above in conjunction with FIG. 5.

A fuel ionization detector 622 may be disposed to sense a degree of ionization of the fuel flowing from the fuel delivery apparatus 510 to the burner 108 and flame 109, and transmit a corresponding sensor signal to the controller portion 620 via a sensor signal transmission path 624. The sensed signal may be used to select an amplitude, frequency, and/or other waveform characteristics delivered to the electrode 512 from the controller portion 620 via the electrode drive signal transmission path 514.

Those skilled in the art will appreciate that the foregoing specific exemplary processes and/or devices and/or technologies are representative of more general processes and/or devices and/or technologies taught elsewhere herein, such as in the claims filed herewith and/or elsewhere in the present application.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A system for controlling a plurality of electric fields in a combustion system including at least one burner supporting a flame, comprising:

an electronic controller programmed to produce at least a first electrode drive signal and a second electrode drive signal independent from the first electrode drive signal;

at least one first electrode arranged proximate a burner and operatively coupled to receive the first electrode drive signal, the first electrode being configured to apply, proximate a flame supported by the burner, a first electric field corresponding to the first electrode drive signal; and at least one second electrode arranged distal, in a direction parallel to a longitudinal axis of the burner, from the burner, relative to the at least one first electrode, and operatively coupled to receive the second electrode drive signal, the second electrode being configured to apply a second electric field corresponding to the second electrode drive signal.

2. The system of claim 1, wherein at least one of the at least one first electrode and at least one second electrode includes at least two electrodes.

3. The system of claim 1, further comprising:

at least one first sensor operatively coupled to the electronic controller and configured to sense a condition proximate the flame supported by the burner.

4. The system of claim 3, wherein the at least one first sensor is configured to sense a combustion parameter of the flame.

5. The system of claim 4, wherein the at least one first sensor includes at least one selected from the group consisting of a flame luminance sensor, a photo-sensor, an infrared sensor, a fuel flow sensor, a temperature sensor, a flue gas temperature sensor, a radio frequency sensor, and a flow sensor.

6. The system of claim 3, wherein the at least one first sensor includes a sensor located proximate the burner.

7. The system of claim 6, further comprising:

at least one second sensor operatively coupled to the electronic controller and configured to sense a condition distal, in the direction parallel to the longitudinal axis of the burner, from the flame supported by the burner, relative to the condition sensed by the at least one first burner.

8. The system of claim 7, wherein the at least one second sensor includes a sensor located distal, in the direction parallel to the longitudinal axis of the burner, from the burner, relative to the at least one first sensor.

9. The system of claim 7, wherein the at least one second sensor includes at least one selected from the group consisting of a transmissivity sensor, a particulate sensor, a temperature sensor, an ion sensor, a surface coating sensor, an acoustic sensor, a CO sensor, an O2 sensor, and an oxide of nitrogen sensor.

10. The system of claim 1, wherein the controller further includes a communications interface configured to receive at least one input variable.

11. The system of claim 10, wherein the controller is further configured to determine at least one parameter of at least one of the first and second electric field drive signals responsive to the at least one input variable.

12. The system of claim 11, wherein the at least one input variable includes at least one selected from the group consisting of fuel flow rate, electrical demand, steam demand, turbine demand, fuel type, carbon footprint cast, and emission credit value.

13. The system of claim 1, wherein the electronic controller is further configured to produce at least one of a fuel flow control signal and an air flow control signal.

14. The system of claim 13, further comprising:

a valve operatively coupled to receive the fuel flow control signal and responsively modulate a fuel flow rate to the burner.

15. The system of claim 13, further comprising:

a blower operatively coupled to receive the air flow control signal and responsively modulate an air flow rate to the flame.

16. The system of claim 1, wherein the electronic controller includes at least a first electronic controller configured to provide the first electrode drive signal and a second electronic controller configured to provide the second electrode drive signal.

17. The system of claim 16, wherein the first and second controllers are operatively coupled to one another.

18. The system of claim 1 wherein the electronic controller is configured to produce the first and second electrode drive signals such that the first and second electric fields produce different responses from one another in a combustion system including the burner.

19. The system of claim 7 wherein the electronic controller is configured to control a parameter of the combustion system by controlling the first and second electrode drive signals such that the first and second electric fields act cooperatively to produce a selected response related to the parameter.

20. The system of claim 7, wherein the electronic controller is configured to control the first electrode drive signal in response to a first sensor signal produced by the at least one first sensor, and to control the second electrode drive signal in response to a second sensor signal produced by the at least one second sensor.

21. The system of claim 7, wherein the electronic controller is configured to control a first parameter of the combustion system by controlling the first electrode drive signal in response to a first sensor signal produced by the at least one first sensor, and to control a second parameter of the combustion system by controlling the second electrode drive signal in response to a second sensor signal produced by the at least one second sensor.

22. An external combustion system, comprising:

at least one burner configured to support at least one flame disposed in a combustion chamber;

an electronic controller programmed to produce at least a first electrode drive signal and a second electrode drive signal independent from the first electrode drive signal;

at least one first electrode positioned proximate to the combustion chamber, operatively coupled to the electronic controller, configured to receive the first electrode drive signal, and configured to apply a first time-varying electric field in the combustion chamber and near the at least one flame; and at least one second electrode positioned downstream of the at least one first electrode and positioned proximate to a heat exchange volume that is positioned and configured to receive at least hot gases from the combustion chamber, the at least one second electrode being operatively coupled to the electronic controller and configured to receive the second electrode drive signal; the at least one second electrode being further configured to apply a second time-varying electric field within the heat exchange volume and near the hot gases.

23. The external combustion system of claim 22, wherein the electronic controller further comprises:

at least one electrode drive circuit configured to drive the at least one first electrode and the at least one second electrode to apply the respective first and second time-varying electric fields.

24. The external combustion system of claim 22, wherein the first and second electric fields have different time variations.

25. The external combustion system of claim 24, wherein the time variation of the first electric field is selected to increase an extent of reaction compared to not applying the first electric field.

26. The external combustion system of claim 24, wherein the at least hot gases include charged particles, and wherein the time variation of the second electric field is selected to drive the charged particles in at least one first direction.

27. The external combustion system of claim 26, wherein driving the charged particles in the first direction also propels at least a portion of the hot gases in the at least one first direction.

28. The external combustion system of claim 26, wherein the at least one first direction impinges upon at least one heat transfer surface.

29. The external combustion system of claim 26, wherein the at least one first direction includes a path back to the combustion chamber.

30. The external combustion system of claim 26, wherein the time variation of the second electric field is selected to sequentially drive the charged particles in the at least one first direction and an at least one second direction.

31. The external combustion system of claim 22, wherein the at least hot gases include charged particles, and wherein the second time varying electric field is configured to separate the charged particles from the hot gases.

32. The external combustion system of claim 22, further comprising:

a fuel delivery system configured to deliver fuel to the at least one burner.

33. The external combustion system of claim 22, further comprising:

a heat delivery system configured to receive heat from at least the hot gases and deliver the heat to a remote location.

34. The external combustion system of claim 33, further comprising:

a steam turbine configured to receive the heat at the remote location.

35. The external combustion system of claim 22, wherein the at least one first electrode is configured to apply the first time-varying electric field to extend through the at least one flame.

* * * * *